United States Patent [19]

Norman

[11] Patent Number: 4,947,781

[45] Date of Patent: Aug. 14, 1990

[54] ATTACHMENT FOR IMPROVING THE RIDE OF SMALL MARINE PLEASURE CRAFT

[76] Inventor: Ralph S. Norman, 6253 Rancho Hills Dr., San Diego, Calif. 92139

[21] Appl. No.: 237,523

[22] Filed: Aug. 26, 1988

[51] Int. Cl.[5] ..... B63B 1/22

[52] U.S. Cl. ..... 114/285; 114/270

[58] Field of Search ..... 114/271, 274, 284–287, 114/292, 270, 126; 441/65, 68, 74, 79

[56] References Cited

U.S. PATENT DOCUMENTS

| | | | |
|---|---|---|---|
| 1,805,131 | 5/1931 | Donaldson | 114/271 |
| 3,084,356 | 4/1963 | Wheat | 441/77 |
| 4,628,852 | 12/1986 | Nishida et al. | 114/270 |

FOREIGN PATENT DOCUMENTS

| | | | |
|---|---|---|---|
| 381178 | 12/1907 | France | 114/271 |
| 282193 | 12/1986 | Japan | 114/270 |

*Primary Examiner*—Joseph F. Peters, Jr.

*Assistant Examiner*—Jesûs D. Sotelo

*Attorney, Agent, or Firm*—Juettner Pyle Lloyd & Verbeck

[57] ABSTRACT

Small marine pleasure craft, such as jet skis, which have a tendency to "porpoise" or pitch fore and aft at cruising speeds, are provided at the aft end of the hull thereof with a ride plate and , pursuant to the invention, with a downwardly and rearwardly inclined lift or hydroplane surface on the ride plate which effectively eliminates the "porpoising" or pitching motion at cruising speeds and also enhances maneuverability and steerability of the craft at such speeds. The angle of downward inclination of the lift or hydroplane surface is quite critical, residing within a range in the order from about 3° to about 6°. The preferred embodiment comprises an accessory device substantially universally adaptable to existing jet skis, which is characterized by a plate having a mounting surface adapted to be secured to a jet ski ride plate and a downwardly and rearwardly inclined lift or hydroplane surface having a preferred universal angle of declination in the order of about 4°.

15 Claims, 1 Drawing Sheet

FIG. 1
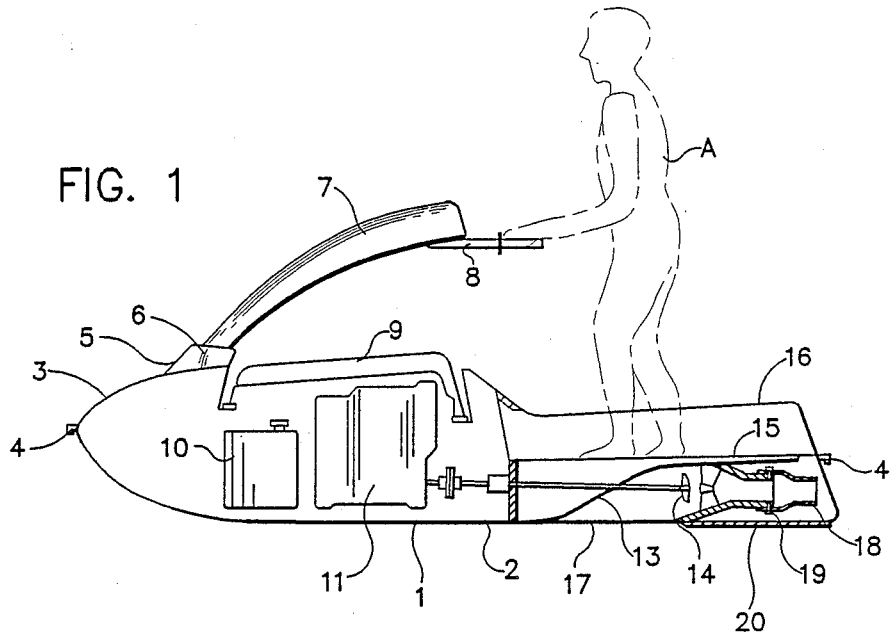
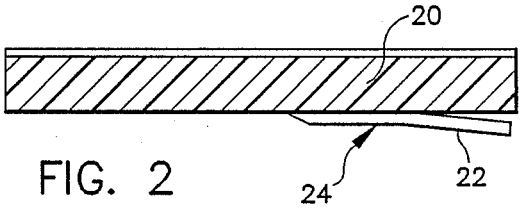
FIG. 2
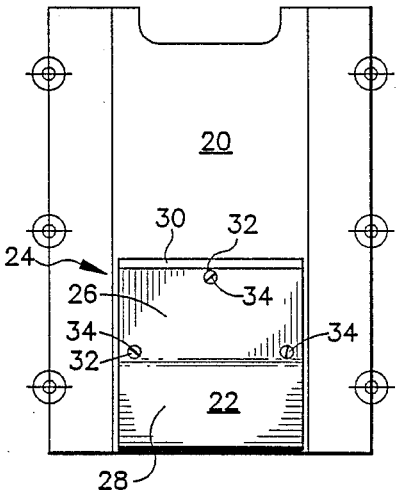
FIG. 4
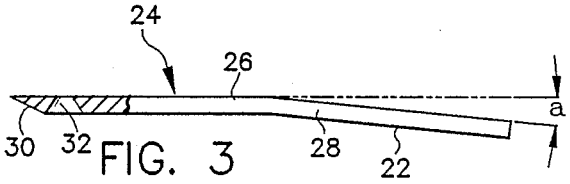
FIG. 3

ATTACHMENT FOR IMPROVING THE RIDE OF SMALL MARINE PLEASURE CRAFT

TECHNICAL FIELD

The present invention relates to small marine pleasure craft, particularly jet skis, and to a novel device for improving the ride, maneuverability and safety of operation of such craft.

BACKGROUND ART

Small marine pleasure craft may take a variety of forms, from conventional boats to hibred vehicles. currently popular craft is the jet ski, an exemplary depiction of which may be found in U.S. Pat. No. 4,628,852, granted Dec. 16, 1986, to Nishida et al.

In the operation of a jet ski at cruising speeds, the craft has a strong tendency to pitch fore and aft in a motion which has come to be called "porpoising" because of a high degree of similarity in appearance to the motion of a porpoise as it moves along the surface of a body of water. This porpoising or pitching motion is very distracting and disconcerting to the operator or occupant of the craft, contributes significantly to operator fatigue, and detracts from the enjoyment and exhilaration of the sport of jet skiing.

Another problematic tendency of many jet skis is to slide or skid sideways or laterally across the water when an attempt is made to turn at cruising speeds, thereby detracting from the maneuverability and safety of operation of the craft.

DISCLOSURE OF THE INVENTION

The object of the present invention is to provide a device that will drastically reduce and in most cases eliminate the tendencies of jet skis and similar craft to porpoise and/or to skid at cruising speeds, thereby to enhance the safety of operation and maneuverability of the craft, to significantly reduce operator fatigue, and to increase individual enjoyment of jet skiing and like sports.

Because the device smooths out the ride of the craft, enhances maneuverability and reduces operator fatigue, the invention contributes significantly to the safety of operation of jet skis and similar craft, and at the same time enhances the fun and enjoyment of small craft water activities.

The invention resides in the addition to the ride plate of a jet ski of a lift plate or hydroplane inclined at a small angle downwardly and rearwardly along the longitudinal axis of the craft at the rear of the ride plate below the jet propulsion nozzle of the craft. The force of water acting against the downwardly inclined surface of the plate, as the craft moves through the water at cruising speeds, imparts an upward force to the rear of the craft which causes the rear of the craft to rise and its nose to drop thereby to preload and set the plane of the craft such that pitching or porpoising is drastically reduced or eliminated.

The invention further resides in the discovery that the angle of downward inclination of the hydroplane or lift plate is quite critical; the reason being that too small an angle will not produce the desired results and too great an angle will force the nose of the craft so low in the water that a smooth ride will not be obtained and the performance of the craft will be significantly impaired.

To achieve the intended objective of the invention with jet skis presently on the market, the angle of declination of the lift surface preferably resides within a range of from about 3° to about 6° to the horizontal plane of the craft, depending upon the construction of the craft, the size and weight of the operator, the dimensions of the lift plate, and the density of the water in which the craft is to be operated. In fresh water, the degree of declination may be in the order of 4° to 6° and in salt water in the order of 3° to 4°, due to the greater density of salt water as compared to fresh water. The angle may also tend toward the higher end of the range for a heavy weight operator and to the lower end of the range for a lighter weight operator. Given the variables involved and the manner of compensating for the same, a modest number of cut and try attempts will readily produce the best results for a given machine, operator, and operating conditions.

Despite the existence of the described variables, it has nevertheless been found that in order to achieve the objects of the invention in a highly practical manner, a lift plate or hydroplane angle of approximately 4° constitutes a "happy medium" well adapted to impart the advantages of the invention to almost all jet skis that are presently available.

In addition to eliminating porpoising or pitching and improving the ride, the lift plate or hydroplane of the invention has been found to significantly reduce and in many cases eliminate the tendency of some jet skis to skid or slide sideways when making turns at cruising speeds. The invention thus contributes to better maneuverability of and operator control over the craft, thereby to enhance safety in operation of the craft.

In its preferred embodiment, the invention is comprised of a small metal plate bent at approximately its midpoint to a desired angle within the standard range, preferably about 4°, which may be sold as an accessory for attachment to the ride plate of any existing jet ski, thereby to make the advantages of the present invention available to all jet ski operators with minimal effort and at nominal cost. Alternatively, the invention could be embodied in replacement ride plates for jet skis, or it could comprise a feature incorporated in the craft as sold by the manufacturer.

By virtue of the invention, the fun of marine sports such as jet skiing can be significantly enhanced, and at the same time, the operator is provided with means that contribute to a reduction in the rate of operator fatigue and an increase in safety of operation.

These and other objects and advantages of the invention will become apparent from the following detailed description, taken in conjunction with the accompanying drawings.

BRIEF DESCRIPTION OF THE DRAWING

FIG. 1 is a schematic illustration in vertical longitudinal section of a type of marine craft, namely a jet ski, to which the invention has particularly useful application;

FIG. 2 is a vertical longitudinal section of a jet ski ride plate equipped with a preferred embodiment of the device of the invention;

FIG. 3 is a side view, on an enlarged scale and partly in section, of the preferred embodiment of the device of the invention; and FIG. 4 is a bottom view of a jet ski ride plate with the device of the invention detachably secured to it.

BEST MODE FOR CARRYING OUT THE INVENTION

The following is a description of the best mode presently known to the applicant for carrying out his invention.

FIG. 1 is a schematic illustration of a small size marine pleasure craft, called a jet ski, which can freely skim over the water surface and is controlled by a navigator A in a standing or kneeling position. A craft body 1 is composed of a hull 2 constituting the lower portion of the body and a deck 3 constituting the upper part thereof, which parts are bonded together through flanges 4 formed at the respective peripheral edges of the hull 2 and the deck 3. A handle pole bracket 5 is secured to a fore portion of the deck 3. A handle pole 7 is mounted on the bracket 5 through a mounting shaft 6 so as to pivot vertically. A handle lever 8 is secured to the handle pole 7. Thus, the navigator A may control the craft by actuating the handle lever 8. An engine cover 9 covers a fuel tank 10 and an engine 11 which are installed inside the body 1. The engine cover 9 is detachably secured to the deck 3 to accommodate convenient access to the fuel tank and the engine.

A duct 13 is provided at the lower side of an aft or rear portion of the craft body 1. A water jet propeller 14 is mounted in the duct 13. The water jet propeller 14 is driven by the engine 11, whereby a propulsive force is obtained. A floor 15 is provided in an aft portion of the deck 3. The floor 15 is designed such as to allow the navigator A to ride comfortably thereon. On both sides of the floor 15, upwardly projecting fins 16 are provided to define the navigator cockpit or operating station for the marine craft.

When the water jet propeller 14 is driven by the engine 11, water from the body of water in which the craft is floating is drawn into the inlet 17 of the water duct 13 and discharged through the propeller into an outlet nozzle 18 where the water is converted into a coherent high pressured jet designed to propel the craft through the water at various speeds depending upon the speed of the engine and the propeller. The speed of the engine is governed by the navigator through conventional manual controls on the handle lever 8. In the embodiment illustrated, the craft is steered by pivoting the jet discharge nozzle 18 in a horizontal arc about a vertical axis defined by mounting pins 19. For steering purposes, a cable or the like (not shown) extends between the navigator's handle lever 8 and a horizontally extending lever arm (not shown) on the steering nozzle 18.

The duct 13 is closed at its lower side by a ride plate 20 which is detactably secured, as by means of bolts, to the hull 2 at opposite sides of the duct.

Referring to FIG. 2, the present invention resides in the provision on the lower surface of the ride plate 20 of an inclined lift or hydroplane surface 22 which extends downwardly and rearwardly adjacent the rearward end of the ride plate at a small angle relative to the horizontal plane of the hull of the craft. Though the angle of inclination of the surface 22 is quite small, it is nevertheless effective to eliminate porpoising or pitching of the craft at cruising speeds.

When a jet ski without my lift surface 22 moves through the water at cruising speeds, the stern rides low in the water and the nose or prow of the craft lifts up out of the water. Consequently, the influence of the prow on the ride and maneuverability of the craft in the water is lost or significantly diminished. The craft instead rides primarily on the stern portion of the hull and the ride plate 20, with the result that the ski pitches fore and aft or "porpoises". This motion is quite annoying and extremely fatiguing to the operator of the craft.

I have found that the addition to the ride plate 20 of the lift surface 22 of my invention drastically reduces or effectively eliminates this pitching or porpoising at cruising speeds, enhances the ride and maneuverability of the craft, significantly reduces operator fatigue, contributes to the safety of operation of the ski, and does not detract from the performance or other operating characteristics of the ski.

As the ski moves through the water at cruising speeds, the force of the water acting on the inclined surface 22 imparts a lifting force to the stern of the craft which in turn causes the prow to ride lower in the water, thereby preloading and setting the plane of the craft in a more ideal relationship with the water at cruising speeds. As a consequence, porpoising or pitching is effectively eliminated, and steerability is enhanced. Moreover, these advantageous results are achieved without any observable change in the other characteristics of the jet ski, i.e., its performance, power requirements, fuel consumption, etc.

I have further discovered that in order to achieve the above described advantages of the invention, the lift or hydroplane surface 22 must meet certain demanding criteria. Too small an angle will not produce the requisite lifting force and too great an angle will force the nose or prow of the craft too deeply into the water, with the consequence that the performance of the craft is significantly impaired and the intended function of the surface 22 is in effect defeated. In determining the angle of declination and the area of the lift surface 22, several variables may be encountered, including the size, weight and construction of the jet ski itself, the size and weight of the operator, and the density of the water in which the ski is to be operated. In fresh water, which is less dense that salt water, or with a heavy operator, or with a large and heavy ski, the angle of declination of the surface 22 (angle "a" in FIG. 3) may be increased to a maximum of about 6°. In salt water, or with a small operator and/or a small ski, the angle may be decreased to a minimum of about 3°. Angles less than about 3° will not do the work required and angles in excess of about 6 degrees commence to defeat the purposes of the invention and impair the performance of the craft. Thus, an acceptable range for the angle of declination "a" of the lift surface 22 of the invention is in the order of from about 3° to about 6°. I have found this range of angles to be quite critical to attainment of the advantages of the invention.

Moreover, I have found that by utilizing a lift surface that has an angle of declination of about 4°, I can extend the advantages of my invention substantially universally to almost all existing jet skis.

In accordance with the invention, the anti-porpoising surface 22 may be incorporated in the craft by the manufacturer as part of the original equipment, or may be formed integrally with a replacement ride plate for a particular craft, or may take the form of a simple, substantially universal, accessorY attachment for practically all jet skis that are currently on the market. In the form thereof preferred by me, the invention is embodied in a simple, universal, accessory device, namely, a plate adapted to be sold as an accessory for convenient attachment to the ride plate of any existing jet ski.

Referring to FIG. 3, the preferred embodiment of the invention is shown as comprising a plate 24 of substantially uniform thickness throughout, which is bent in the vicinity of its transverse midpoint to provide a first substantially planar mounting portion 26 and a second, inclined lift or hydroplane surface portion 28, the lower face of the portion 28 defining the lift or hydroplane surface 22. The plate 24 is preferably a corrosion resistant, sturdy metallic plate, for example, anodized aluminum. For conventional jet ski ride plates having a length of about 12 to 16 inches and a width of about 8 to 12 inches, the plate 24 may be approximately 6 inches long, about 4 to 6 inches wide, and about ⅛ inch thick. The bend in the plate is preferably made on a precision press to produce an angle of declination "a" of about 3 to 4 degrees, and preferably precisely 4°. The bend is so located that the lift surface of portion 28 of the plate is about 2½ to 3 inches long, preferably about 2¾ inches long. The forward or leading edge 30 of the planar mounting portion 26 is preferably tapered at an angle of about 22 degrees to reduce drag, and the two sides of the plate are preferably chamfered at an angle of about 45 degrees.

To adapt the lift plate to various sizes and models of jet skis, I find it adequate to vary the width of the plate 24, while maintaining all the other dimensions above described. Specifically, for the smaller jet skis, such as the 300 to 500 class models, I prefer a plate width of about 4½ inches to achieve the intended and desired objective. For larger skis, such as the 600 series, I prefer a plate width of 6 inches to compensate for the larger size of the craft and also in anticipation that such craft will usually be operated by larger and heavier individuals.

To facilitate mounting of the plate 24 on a ride plate 20, the first or planar mounting portion 26 thereof is provided from its lower surface inward with three countersunk holes 32 (FIGS. 3 and 4) for reception of stove or plow bolts 34 (FIG. 4) so that the plate 24 can be bolted to the ride plate 20 without having the heads of the bolts protrude from the lower surface of the plate portion 26 (as shown in FIG. 2.

The plate 24 is so mounted that the rearward edge of the inclined portion 28 is aligned generally with the rearward or aft edge of the ride plate 20 so as to impart the lifting force as far rearwardly as practicable and yet not interfere with any of the remaining structure or features of the jet ski craft itself.

To effect installation, the ride plate 20 is preferably unbolted from the hull of the jet ski and laid bottom face up on a work surface. The plate 24 is then placed on the ride plate with the rear or back edges and the longitudinal center lines of the two plates aligned with one another, and with the top side of the mounting portion 26 flush against the bottom side of the ride plate. Using one of the holes 32 in the plate 24 as a guide, preferably the hole 32 adjacent the leading edge 30 of the plate, a first hole is drilled through the ride plate and one of the bolts 34 is inserted through the aligned holes and fastened in place to initially secure the plate 24 to the plate 20. Holes may then be drilled through the ride plate in alignment with the other two bolt holes 32, using the bolt holes as guides, and the remaining two bolts 34 may then be inserted and fastened in place to complete the installation of the plate 24 on the ride plate 20. Lock nuts (not shown) are preferably used in connection with the bolts 34 to ensure that the installation of the plate 24 on the ride plate 20 will remain in fixed position throughout the useful life of the jet ski. The ride plate may then be returned to and secured in its proper position on the hull 2.

In this manner, the advantages of the present invention can be incorporated in almost any jet ski at nominal cost and with a minimum of effort. When installed, the attachment plate 24 is practically indestructible. The ski when out of the water can be placed, even dropped, on a hard surface, without damaging the inclined plate portion 28 and its lift surface 22. This portion of the plate will simply flex under the load and return to its originally designed degree of declination when removed from the supporting surface and placed in the water. In the water, when the craft is operated at cruising speeds, the lift or hydroplane surface 22 defined by the incline plate portion 28 will cause the stern of the craft to rise and its nose to lower to preload and set the plane of the craft in the water such that porpoising is virtually eliminated and steering and maneuverability are enhanced.

Thus, the objects and advantages of the invention have been shown to be achieved in a practical, economical and facile manner.

While the presently preferred embodiment of the invention has been herein illustrated and described, it is to be appreciated that various changes, modifications, and rearrangements can be made therein without departing from the scope of the invention as defined by the appended claims.

I claim:

1. An attachment for improving the ride of a marine pleasure craft having a hull, a propulsion means in the hull and a ride plate on the hull below the propulsion means, the attachment consisting essentially of a rigid, unitary plate having relatively inclined first and second surface portions, said second surface portion being inclined to said first surface portion at an angle of declination in the order of from about 3° to about 6°, said first surface portion being adapted to be fixedly secured flush against the lower surface of the ride plate with said second surface portion inclined downwardly and rearwardly from the lower surface of the ride plate along the center line of the craft, said second surface portion having a width in the order of from about 4 to about 6 inches and a length in the order of about 2½ to 3 inches.

2. An attachment as set forth in claim 1, wherein the angle of declination of said second surface portion is in the order of about 4°.

3. An attachment as set forth in claim 1, wherein said second surface portion has a length in the order of about 2¾ inches.

4. An attachment as set forth in claim 1, wherein said second surface portion has a rearward edge aligned generally with the rearward edge of the ride plate.

5. The attachment of claim 1, wherein said second surface portion has a width of about 4½ inches.

6. The attachment of claim 1 wherein said second surface portion has a width of about 6 inches.

7. An attachment for improving the ride of a marine pleasure craft having a ridge plate, comprising a plate of generally uniform thickness throughout which is bent in the vicinity of its transverse center line to define relatively inclined first and second surface portions, said second surface portion being inclined to said first surface portion at an angle of declination in the order of from about 3° to about 6°, said first surface portion being adapted to be secured to the lower surface of the ride plate forwardly of the rearward edge of the ride plate with said second surface portion inclined downwardly and rearwardly along the center line of the craft and with the rearward edge of said second surface portion aligned generally with the rearward edge of the ride plate.

8. An attachment as set forth in claim 7, wherein said first surface portion has a forward leading edge inclined at an angle in the order of about 22° relative to the plane of said first surface portion.

9. An attachment as set forth in claim 7, wherein said first surface portion is provided, inwardly from the lower face thereof, with a plurality of counter sunk holes therethrough acomodating attachment of said first surface portion to the ride plate by means of stove or plow bolts so that the heads of the bolts will not protrude from the lower face of said attachment plate when said attachment plate is mounted on the ride plate.

10. An improved ride plate for a marine pleasure craft having a hull and a propulsion means in the hull adjacent the aft end of the craft, the ride plate being adapted to be attached to the hull of the craft adjacent the aft end of the craft below the propulsion means of the craft, wherein the improvement comprises a hydroplane lift surface on the lower surface of the ride plate adjacent the rearward end thereof, said lift surface being inclined downwardly and rearwardly along the longitudinal center line of the craft at an angle in order of from about 3° to about 6°, said lift surface having a width in the order of from abut 4 to about 6 inches and a length in the order of about 2½ to 3 inches.

11. A ride plate as set forth in claim 10 wherein said lift surface has a downward and rearward angle of inclination in the order of about 4°.

12. A ride plate as set forth in claim 10, wherein said lift surface has a rearward edge aligned generally with the rearward edge of the ride plate.

13. In a small marine pleasure craft, such as a jet ski, having a ride plate centered generally horizontally along the longitudinal axis of the hull of the craft adjacent the aft end of the hull, the improvement comprising a hydroplane lift surface on the ride plate inclined downwardly and rearwardly along the longitudinal axis of the hull at an angle in the order of from about 3° to about 6°, said lift surface having a width in the order of from about 4 to about 6 inches and a length in the order of about 2½ to 3 inches.

14. The improvement of claim 13 wherein the rearward edge of said lift surface is aligned generally with the rearward edge of the ride plate.

15. The improvement of claim 13, wherein said lift surface has a downward and rearward angle of inclination in the order of about 4°.

* * * * *